US008819879B1

(12) United States Patent
Day et al.

(10) Patent No.: US 8,819,879 B1
(45) Date of Patent: Sep. 2, 2014

(54) THERAPEUTIC TREATMENT TABLE

(75) Inventors: Greg Day, Cleveland, TN (US); Ken Bolam, Apex, NC (US); Jeff Powe, Hixson, TN (US); Rainer Teufel, Columbus, OH (US)

(73) Assignee: Encore Medical Asset Corporation, Henderson, NV (US)

( * ) Notice: Subject to any disclaimer, the term of this patent is extended or adjusted under 35 U.S.C. 154(b) by 0 days.

(21) Appl. No.: 12/291,606

(22) Filed: Nov. 12, 2008

Related U.S. Application Data

(60) Provisional application No. 61/002,839, filed on Nov. 13, 2007.

(51) Int. Cl.
*A47B 3/00* (2006.01)

(52) U.S. Cl.
USPC ..... 5/620; 5/623; 5/600; 5/621; 5/646; 5/160; 108/6; 108/7; 108/9; 108/145

(58) Field of Classification Search
USPC ..... 5/623, 620, 600, 621, 646; 248/118, 248/286.1, 284.1, 291.1, 371; 297/160, 297/162, 411.21, 411.3, 411.32; 108/6, 7, 108/9, 145
See application file for complete search history.

(56) References Cited

U.S. PATENT DOCUMENTS

| | | | | |
|---|---|---|---|---|
| 5,881,984 | A * | 3/1999 | Lin | 248/284.1 |
| 6,601,812 | B2 * | 8/2003 | LeClair et al. | 248/286.1 |
| 6,684,426 | B1 * | 2/2004 | Lin et al. | 5/620 |
| 6,754,923 | B2 * | 6/2004 | Borders et al. | 5/624 |
| 6,957,461 | B2 * | 10/2005 | Osborne et al. | 5/618 |
| 6,967,309 | B2 * | 11/2005 | Wyatt et al. | 219/217 |
| 7,296,312 | B2 * | 11/2007 | Menkedick et al. | 5/611 |
| 2006/0123546 | A1 * | 6/2006 | Horton et al. | 5/613 |

* cited by examiner

*Primary Examiner* — Robert G Santos
*Assistant Examiner* — Ifeolu Adeboyejo
(74) *Attorney, Agent, or Firm* — Knobbe, Martens, Olson & Bear, LLP.

(57) ABSTRACT

A therapeutic treatment table comprises a frame and a treatment platform that is mounted on the frame and adapted to support at least a portion of the body of a patient. A preferred treatment table also includes an arm support section which is mounted on the frame. The arm support section comprises an arm support that is moveable by a patient on the table independently of the treatment platform.

27 Claims, 10 Drawing Sheets

THERAPEUTIC TREATMENT TABLE

CROSS REFERENCE TO RELATED APPLICATION

This application claims the benefit of provisional Application No. 61/002,839, which was filed on Nov. 13, 2007.

FIELD OF THE INVENTION

The present invention relates generally to treatment tables or examination tables, and more particularly to a table which includes a treatment platform that is adapted to support at least a portion of the body of a patient.

BACKGROUND OF THE INVENTION

Various tables are known for supporting a patient for examination or for providing physical therapy. Generally the tables include a horizontal surface on which a patient lies for examination or therapy. Some such tables are simple non-mechanized tables while others may include mechanisms by which the treatment platform or supporting surface may be raised or lowered to a suitable height above the floor on which the table is placed. Some tables include one or more body support sections which together comprise the treatment platform for the table. Thus, for example, a treatment platform may comprise a head section which supports the patient's head, a thoracic section which supports the patient's shoulders and upper torso, and a pelvic section which supports the patient's hips and legs. In most such tables which include separate body support sections, one or more of these sections will be provided with an actuating mechanism, so that the section may be independently moved with respect to one or more of the other sections or with respect to the frame. These types of tables are frequently used by chiropractors for treating patients suffering from a variety of orthopedic and neuropathic maladies.

In some therapeutic treatments performed on therapeutic treatment tables, it is desirable or necessary to place the patient in a supine or face-up position on the table, and in some treatments, it is desirable or necessary to place the patient in a prone or face-down position. Frequently, tables which are adapted for treatment of a patient in a prone position will have a cut-out or recess in the head section to receive and support the patient's face. Some such tables include a removable plug section that can be inserted in the cut-out to make the table more suitable for use with a supine patient. Tables for treatment of a patient in a prone position may also include an arm support section that is fixed to the thoracic section or to the head section. However, because the prone patient's shoulders are supported on the thoracic section and his head is supported on a separate section, it may be difficult to position the arm support section in such a way that is comfortable for the patient. It would be desirable if a treatment table could be provided that would comprise an improvement in providing comfortable arm support for the prone patient.

As mentioned above, it is common for therapeutic treatment tables to have a mechanism or mechanisms for raising and lowering the treatment surface of the table with respect to the support surface or floor on which the table rests. Some of these tables include a control panel on one side with buttons or levers to actuate the raising/lowering mechanism, and others may include a crank for actuating a scissor-type jack mechanism. However, many such tables typically provide a single access point for an operator to actuate the raising/lowering mechanism. It would be desirable if an improved table could be provided that has multiple access points from which an operator can raise or lower the treatment surface of the table.

It is common for the treatment platforms of the various support sections of a treatment table to include a support board of wood, metal or plastic, a foam pad or layer, and an upper and outer layer of vinyl or other fabric. This fabric layer may comprise several pieces that are sewn together to cover the foam layer, and the fabric layer may then be fastened to or around the support board. Such construction is labor intensive to manufacture and its fabric layer is subject to cutting and tearing in use. Such cuts and tears in the fabric may reduce the comfort of the patients who are treated on the table, even if the cuts and tears are repaired. In addition, cuts and tears in the outer fabric provide sites for bacterial growth which may create an unhygienic situation. It would be desirable if a treatment platform construction could be provided that would avoid or minimize these problems.

NOTES ON CONSTRUCTION

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

The use of any and all examples or exemplary language (e.g., "such as") herein is intended merely to better illuminate the invention and does not pose a limitation on the scope of the invention unless otherwise claimed. Nothing in the specification should be construed as indicating any non-claimed element as essential to the practice of the invention.

Various terms are specifically defined herein. These terms are to be given their broadest possible construction consistent with such definitions, as follows:

As used herein, the term "fluid actuator" and similar terms refers to a pneumatic or hydraulic device which includes a cylinder, a piston within the cylinder, and a rod attached to the piston. Fluid pressure within the cylinder on one side of the piston that is higher than the fluid pressure on the opposite side of the piston will cause the rod to extend from the cylinder or to retract into the cylinder.

As used herein, the terms "up", "upward", "upwardly", and similar terms refer, with respect to a treatment table, to a direction away from the surface on which the table rests. The terms "down", "downward", "downwardly", and similar terms refer to a direction towards the surface on which the table rests.

SUMMARY OF THE INVENTION

The invention comprises a therapeutic treatment table which includes a frame and a treatment platform for supporting at least a portion of the body of a patient. The treatment platform is mounted on the frame. A preferred embodiment of the invention includes an arm support section that is also mounted on the frame so as to be neutrally buoyant. The arm support section comprises an arm support that is moveable by a patient on the table independently of the treatment platform.

In another embodiment of the invention, the frame of the therapeutic treatment table includes a base and a support frame to which the treatment platform and the arm support section are attached. In this embodiment of the invention, the support frame is adapted for movement between a lowered position and a plurality of raised positions.

In yet another embodiment of the invention, the treatment platform of the therapeutic treatment table comprises a support board and an integral skin foam layer that is attached to the support board. In this embodiment of the invention, the integral skin foam layer is preferably molded to include a recessed area to improve patient comfort and security. Furthermore, the preferred integral skin foam layer is formed from material having anti-microbial properties.

In order to facilitate an understanding of the invention, the preferred embodiments of the invention, as well as the best mode known by the inventors for carrying out the invention, are illustrated in the drawings, and a detailed description thereof follows. It is not intended, however, that the invention be limited to the particular embodiments described or to use in connection with the apparatus illustrated herein. Therefore, the scope of the invention contemplated by the inventors includes all equivalents of the subject matter recited in the claims, as well as various modifications and alternative embodiments such as would ordinarily occur to one skilled in the art to which the invention relates. The inventors expect skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiments of the invention are illustrated in the accompanying drawings, in which.

DESCRIPTION OF THE PREFERRED EMBODIMENTS OF THE INVENTION

Figure 1:
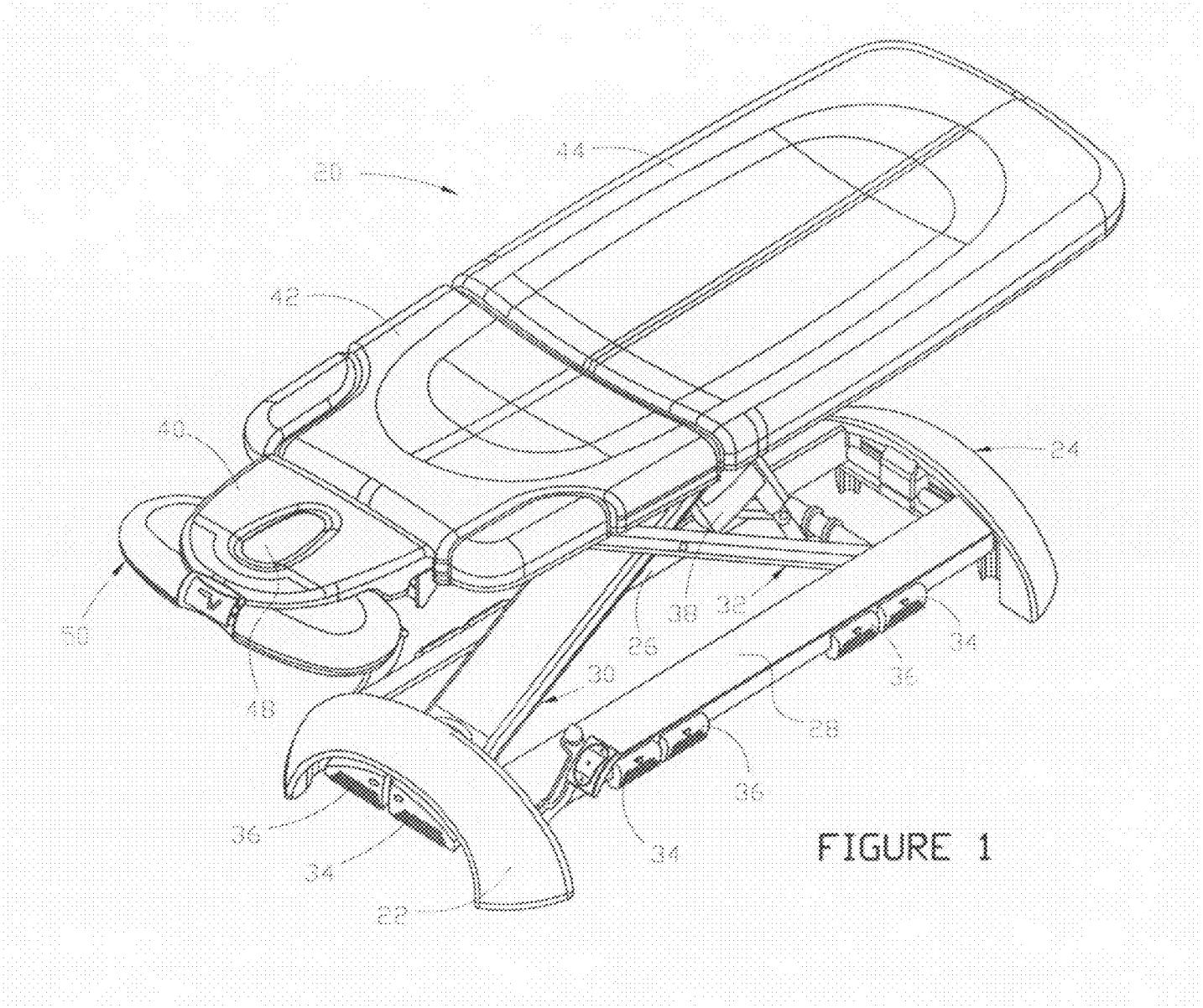
FIG. 1 is a perspective view of a preferred embodiment of the invention, showing the arm support of the treatment table at an upper position in which the arm support is adjacent to the head support section.
Figure 2:
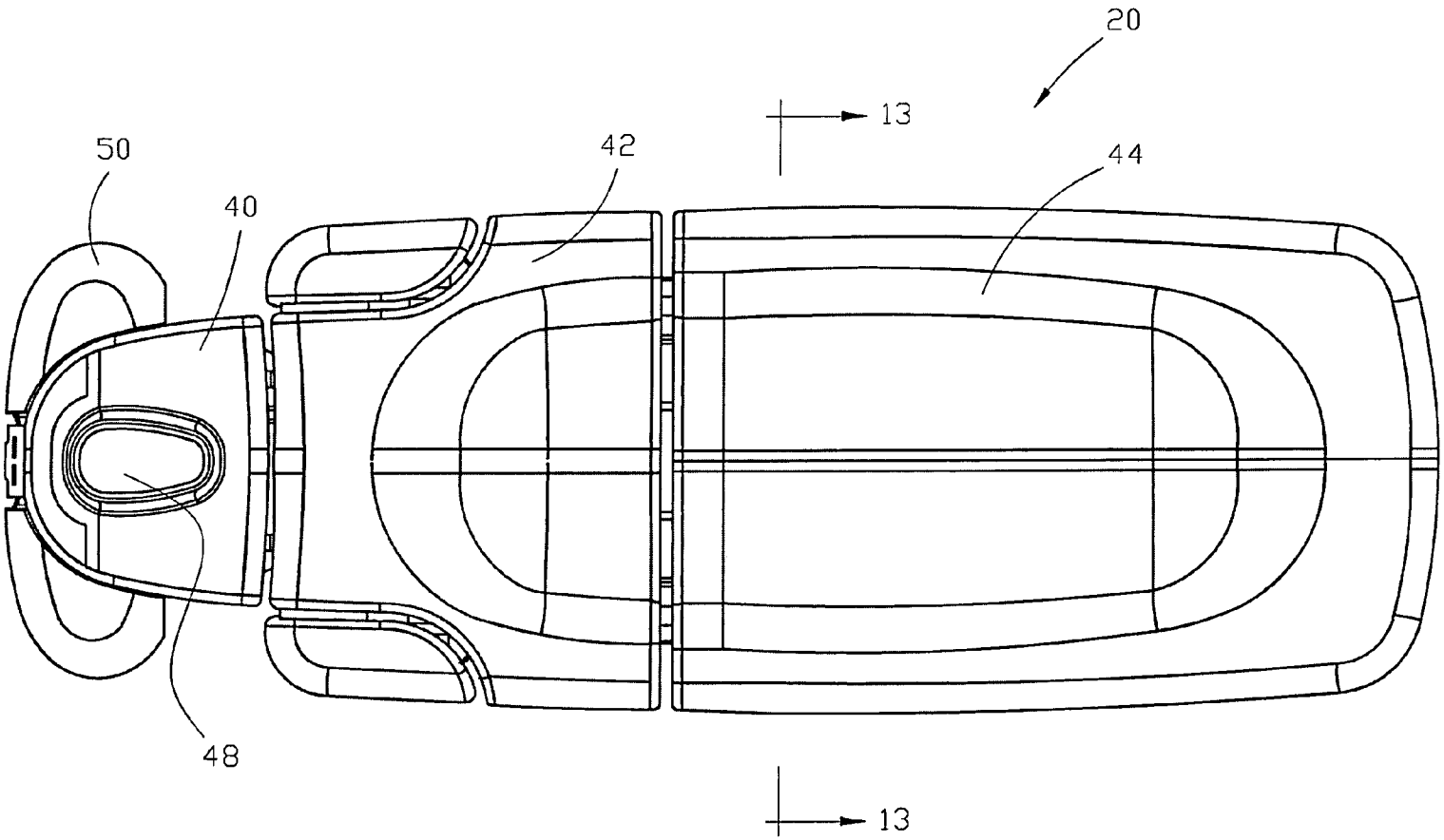
FIG. 2 is a top view of the treatment table of FIG. 1.
Figure 3:
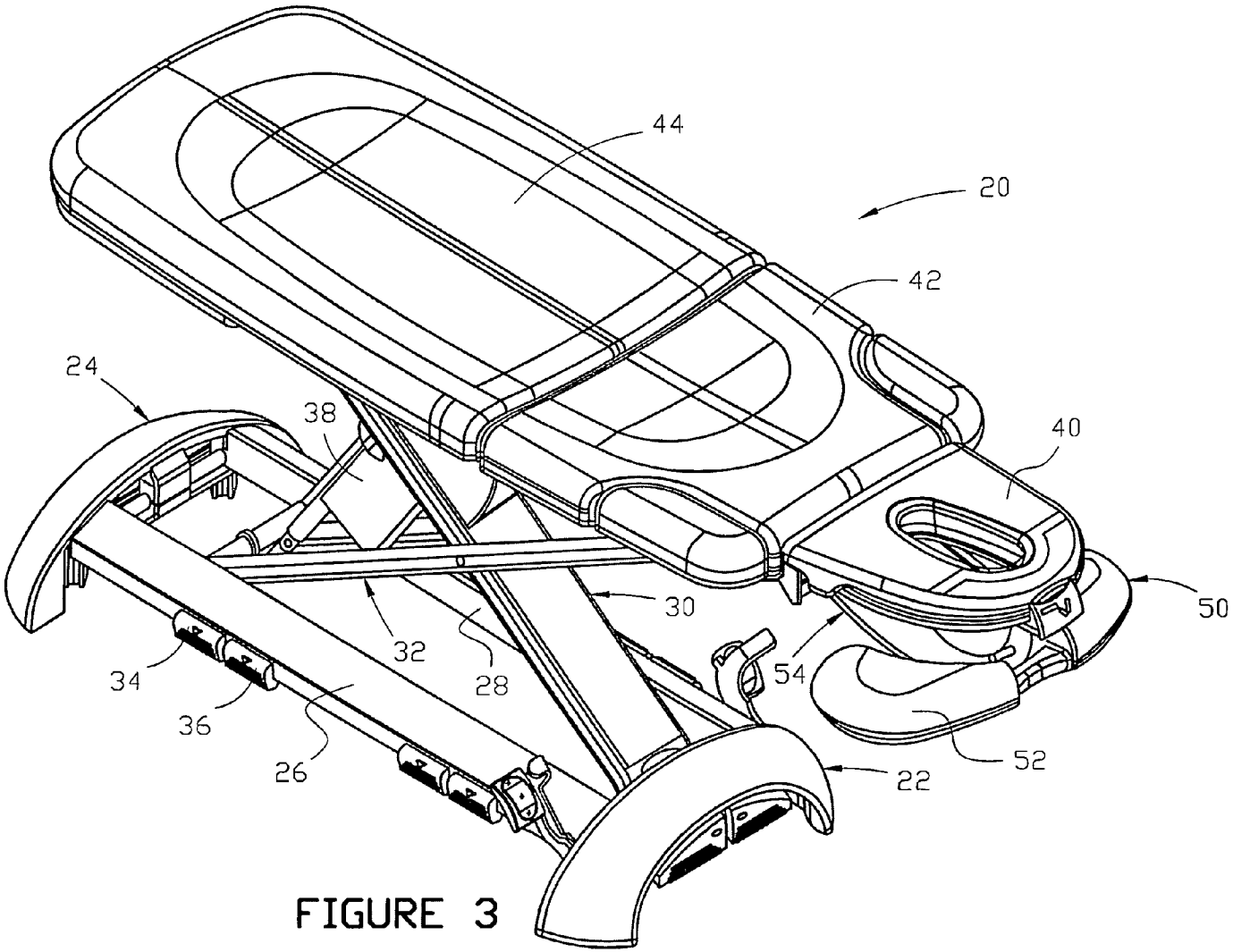
FIG. 3 is a perspective view of the treatment table of FIGS. 1 and 2, showing the arm support of the treatment table at a lower position.

Referring now to the drawings, FIGS. 1-11 and 13 illustrate a preferred embodiment of a treatment table that is used for therapeutic treatment. Table 20 comprises a treatment platform that is adapted to support at least a portion of the body of a patient and a frame to which the treatment platform is mounted. The frame comprises a base including front base portion 22, rear base portion 24, and side base members 26 and 28, and a support frame comprising front support component 30 and rear support component 32. The support frame is adapted for movement between a lowered position (not shown) and a plurality of raised positions (one of which is shown in FIGS. 1 and 3). A plurality of pairs of switches, each of which includes "up" switch 34 and "down" switch 36, are provided at various locations around the table and operatively connected to drive motor 38 of a conventional screw drive mechanism so that the switches may be activated to initiate movement of the support frame with respect to the base. In this way, the support frame may be moved between a lowered position and a plurality of raised positions. Preferably, a pair of switches is mounted on front base portion 22, a pair of switches is mounted on rear base portion 24, and two pairs of switches are mounted on each of side base members 26 and 28, as shown in FIGS. 1, 3, 5, 6 and 7.

Figure 5:
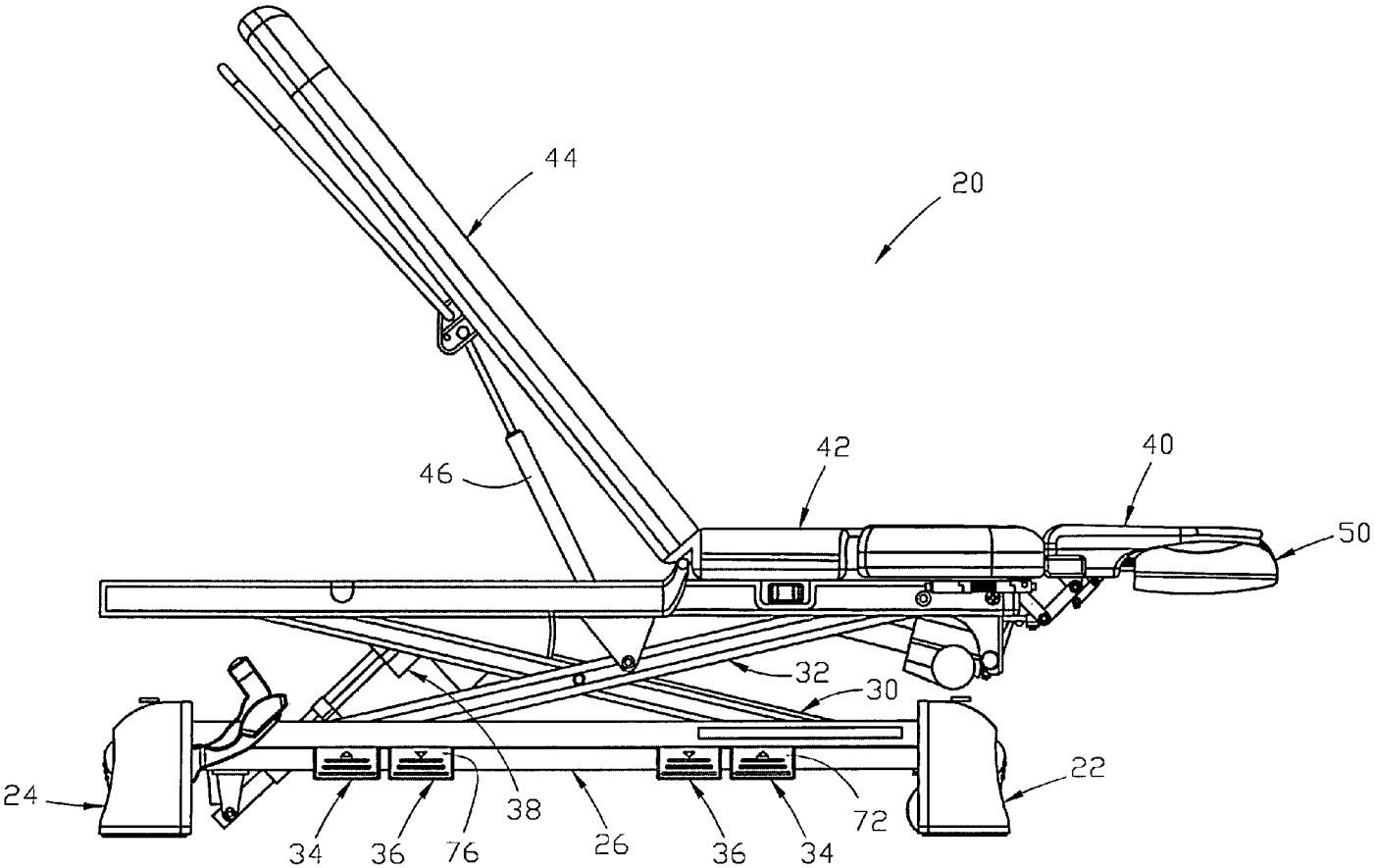
FIG. 5 is a side view of a treatment table such as is shown in FIGS. 1-4, in which the pelvic support section is raised to an elevated position.
Figure 6:
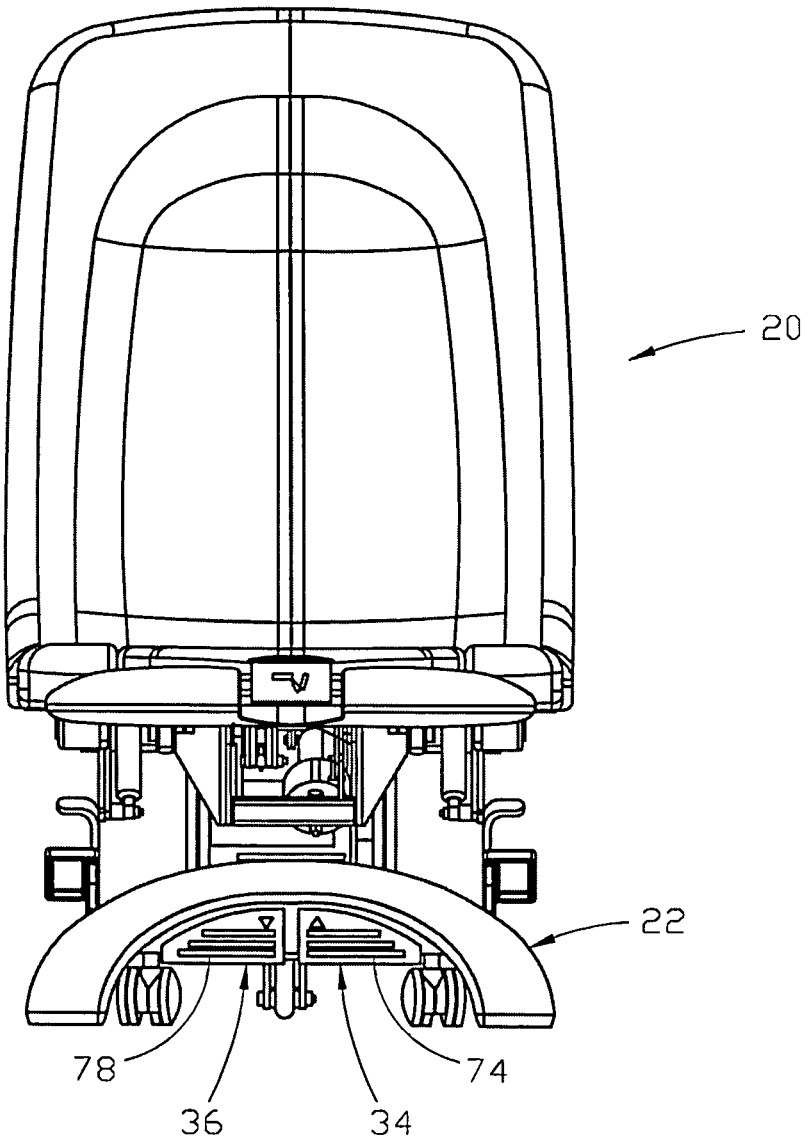
FIG. 6 is a front view of the embodiment of the invention illustrated in FIG. 5.
Figure 7:
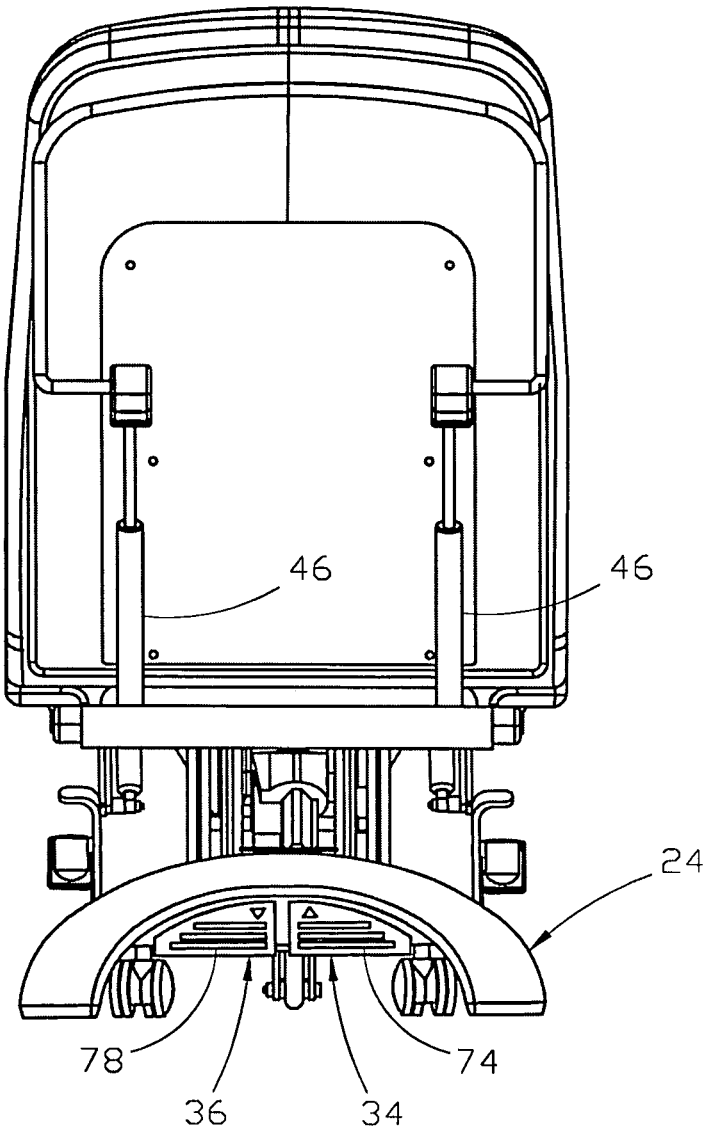
FIG. 7 is a rear view of the embodiment of the invention illustrated in FIGS. 5 and 6.
Figure 9:
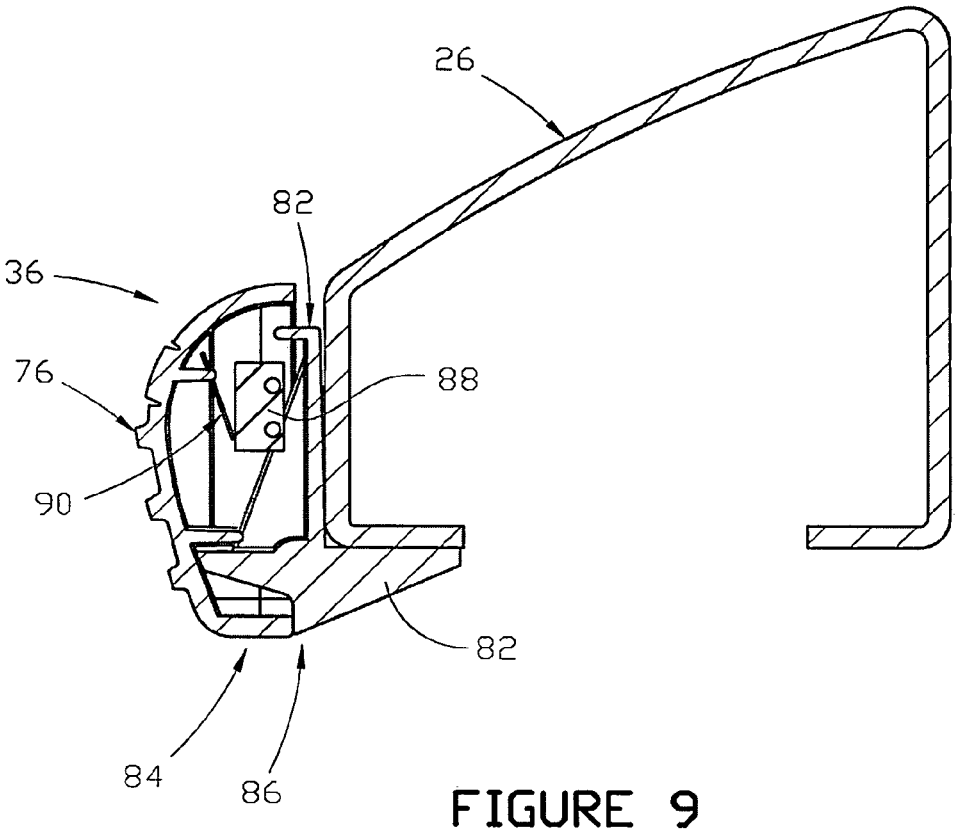
FIG. 9 is a sectional view taken through line 9-9 of FIG. 8.
Figure 8:
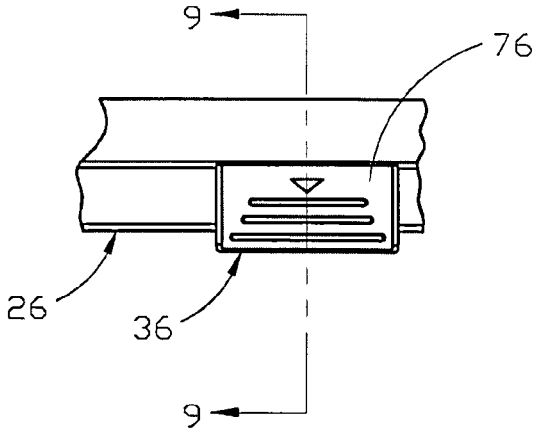
FIG. 8 is a partial view of a portion of the frame of the treatment table of FIGS. 1-7, showing a switch for moving the support frame with respect to the base.

The preferred treatment platform comprises three body support sections: head support section 40 which is adapted to support the head of a patient, thoracic section 42 which is adapted to support the shoulders and upper torso of a patient, and pelvic section 44 which is adapted to support the patient's hips and legs. Any of the three body support sections may include an actuating mechanism for moving the section with respect to one or more of the other sections or with respect to the frame. Thus, as shown in FIGS. 5 and 7, two fluid actuators 46 are provided to tilt the pelvic section of preferred table 20 with respect to the frame. However, the invention encompasses various embodiments, some of which do not require that the treatment platform include any such actuating mechanisms, and some of which do not require that it include multiple body support sections. In fact, the invention may be incorporated in a treatment platform which comprises a single fixed body support section that is adapted to support at least a portion of the body of a patient.

Figure 4:
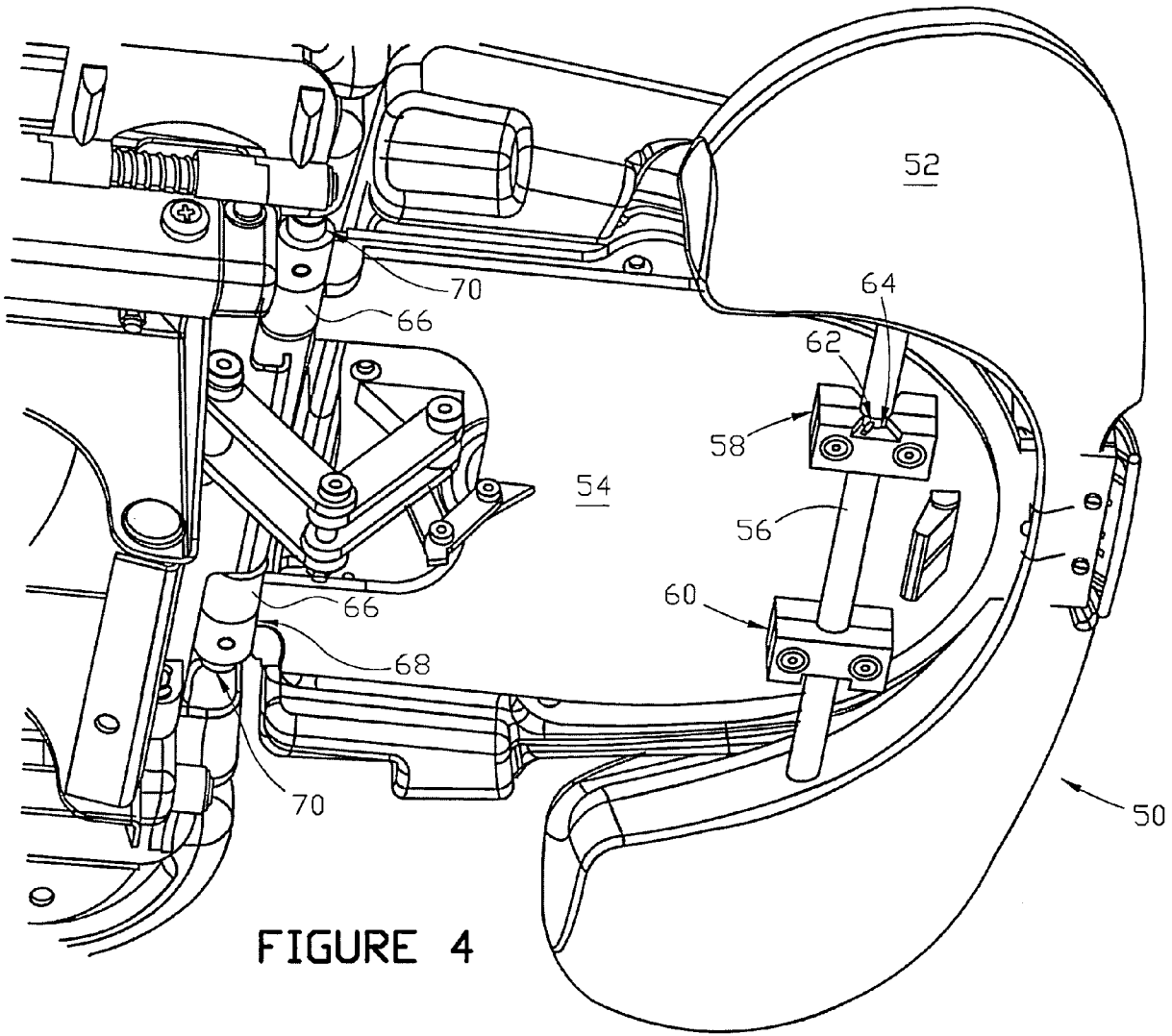
FIG. 4 is perspective view of the bottom portion of the head section and arm support of the treatment table of FIGS. 1-3, showing the arm support at an angled position.

Because it is common to place the patient face down on the table for treatment, head section 40 includes face cutout 48. Adjacent to head section 40 is arm support section 50 which, as shown in FIG. 4, comprises arm support 52, arm support base 54 and rotation bar 56. Rotation bar 56 is mounted within friction brackets 58 and 60 which support the bar with a slight friction fit, so that the arm support is neutrally buoyant. A pair of stop pins (one of which, pin 62 is shown in FIG. 4) are mounted in the rotation bar and adapted to cooperate with angled cutouts in the friction brackets (such as cutout 64) to limit the rotation of the rotation bar, and thus the angle of the arm support, within a range of about 45°. In addition, arm support base includes hinge portion 66 at first end 68, which hinge portion is pivotally mounted with a slight friction fit on base mounting rod 70 near the thoracic section of the table so that the arm support base may rotate to permit the arm support base to be lowered (as shown in FIG. 3) below the upper position shown in FIG. 1. Of course, arm support 52 may be mounted in other ways known to those having ordinary skill in the art to which the invention relates so as to allow a patient to move the arm support independently of the treatment platform to a desired level below the head support section and/or to an angled position that provides the most comfort.

FIGS. 8-11 illustrate the operation of switches 34 and 36. Although the outer housing 72 of "up" switches 34 on side base portions 26 and 28 (illustrated in FIGS. 1, 3 and 5) is configured slightly differently from the outer housing 74 of "up" switches 34 on front base portion 22 (shown in FIG. 6) and rear base portion 24 (shown in FIG. 7), the "up" switches are all functionally equivalent. Similarly, although the outer housing 76 of "down" switches 36 on side base portions 26 and 28 (shown in FIGS. 1, 3, 5, 8 and 10) is configured slightly differently from the outer housing 78 of "down" switches 36 on front base portion 22 (shown in FIG. 6) and rear base portion 24 (shown in FIG. 7), the "down" switches are all functionally equivalent. Furthermore, the "up" switches are functionally identical to the "down" switches, with the only difference being that the "up" switches are wired to motor 38 in such a way that activation of an "up" switch will cause the support frame to move upwardly, whereas the "down" switches are wired to motor 38 in such a way that activation of a "down" switch will cause the support frame to move downwardly. When a preferred switch is activated, movement is initiated and either an upward or a downward direction, and such movement continues as long as the switch is activated.

Figure 11:
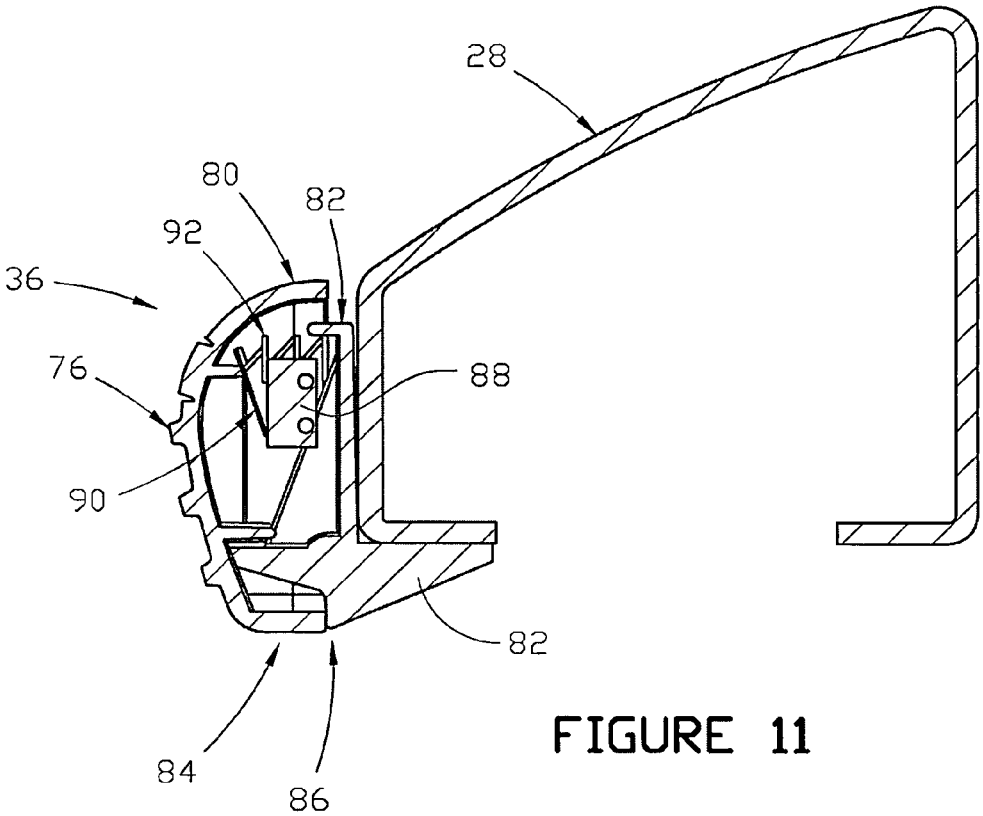
FIG. 11 is a sectional view taken through line 11-11 of FIG. 10.
Figure 10:
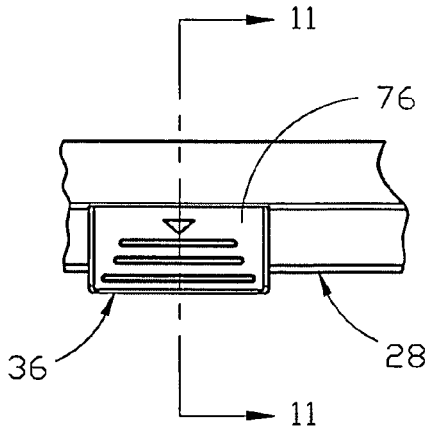
FIG. 10 is a partial view of a portion of the frame of the treatment table of FIGS. 1-7, showing a switch for moving the support frame with respect to the base.

As shown in FIG. 11, upper portion 80 of housing 76 of "down" switch 36 is spaced from base portion 28 with an intermediate bracket 82 interposed therebetween, whereas lower portion 84 of housing 76 abuts the intermediate bracket at abutment 86. A switch element 88 is contained within the housing, to which switch contact 90 is pivotally attached. Spring 92 is provided to bias the switch contact away from the switch element, as shown in FIG. 11. When upper portion 80 of housing 76 is pushed to the right (as viewed in FIGS. 9 and 11), the housing will pivot about the abutment 86. This movement will cause the bias of spring 92 to be overcome, so that switch contact 90 will pivot to make electrical contact with switch element 88, thereby energizing or activating switch 36.

Figure 12:
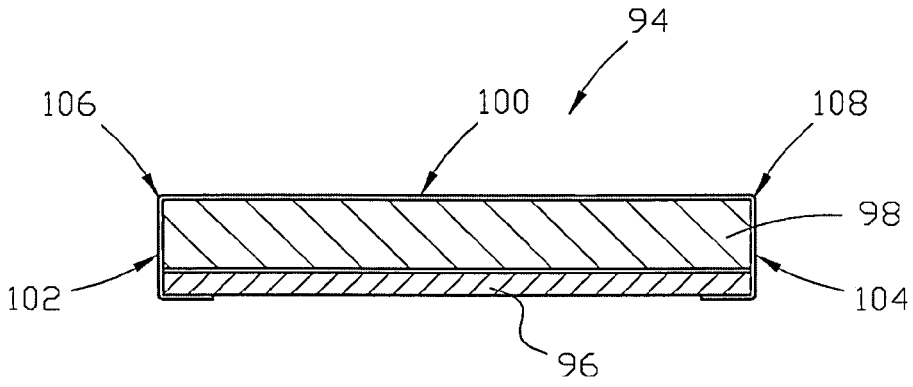
PRIOR ART FIGURE 12
FIG. 12 is a sectional view of a portion of the treatment platform for a support section of a conventional treatment table, showing the construction of such treatment platform.
Figure 13:
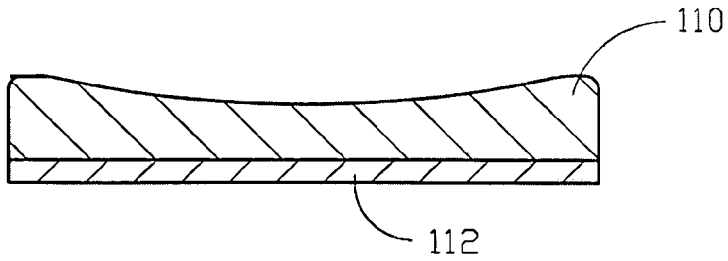
FIG. 13 is a sectional view of a portion of the support platform of the treatment table of FIGS. 1-11, taken through line 13-13 of FIG. 2.

FIG. 12 illustrates the construction of a conventional treatment platform of a support section of a conventional treatment table. As shown therein, conventional treatment platform 94 includes support board 96 of wood, metal or plastic, foam pad or layer 98, and an upper and outer layer of vinyl or other fabric. As shown in FIG. 12, this fabric layer comprises upper piece 100 and side pieces 102 and 104. The side pieces are sewn to the edges of the upper piece at seams 106 and 108, and the ends of side pieces 102 and 104 are folded around support board 96 and stapled, glued or otherwise attached to the bottom surface of the support board. Because such construction is labor intensive to manufacture and its fabric layer is subject to cutting and tearing in use, an improved treatment platform construction is illustrated in FIG. 13. As shown therein, integral skin foam layer 110 is glued or otherwise attached to support board 112. The integral skin foam layer may be molded into the desired shape (which may include a recessed area to improve patient comfort, security and stability). Integral skin foam may also be formed from material that has anti-microbial properties so that any cuts or tears will not create sites for bacterial growth.

Although this description contains many specifics, these should not be construed as limiting the scope of the invention, but as merely providing illustrations of some of the presently preferred embodiments thereof, as well as the best mode contemplated by the inventors of carrying out the invention. The invention, as described herein, is susceptible to various modifications and adaptations, as would be understood by those having ordinary skill in the art to which the invention relates, and the same are intended to be comprehended within the meaning and range of equivalents of the appended claims.

What is claimed is:

1. A therapeutic treatment table comprising:

(a) a frame;

(b) a treatment platform that is mounted on the frame and adapted to support at least a portion of the body of a patient;

(c) a friction bracket;

(d) an arm support section mounted on the frame, said arm support section comprising an arm support positioned to support a patient's arm and being moveable by a patient on the table independently of the treatment platform, wherein the arm support has a first portion positioned on a first side of the frame, and a second portion positioned on a second side of the frame; and (e) a rotation bar with a first end mounted to the first portion of the arm support and a second end mounted to the second portion of the arm support, wherein the rotation bar is retained by the friction bracket with a friction fit such that the friction bracket resists rotation of the rotation bar when the patient's arm rests upon the arm support, but a force applied to the arm support rotates the rotation bar within the friction bracket to adjust the angular position of the arm support relative to the frame.

2. The therapeutic treatment table of claim 1 wherein:

(a) the treatment platform comprises a head support section for supporting the head of the patient;

(b) the arm support is moveable between an upper position in which the arm support is adjacent to the head support section and a plurality of lowered positions in which the arm support is below the head support section.

3. The therapeutic treatment table of claim 1 wherein:

(a) the treatment platform comprises a head support section for supporting the head of the patient;

(b) the arm support is moveable between an upper position in which the arm support is adjacent to the head support section and a plurality of angled positions.

4. The therapeutic treatment table of claim 1 wherein the arm support is mounted with a friction fit to the frame so as to be neutrally buoyant.

5. The therapeutic treatment table of claim 1 wherein the arm support section comprises:

(a) an arm support base that is mounted to the frame, wherein the friction bracket is mounted to the arm support base and wherein the cooperation between the rotation bar and the friction bracket allows the arm support to rotate with respect to the arm support base.

6. The therapeutic treatment table of claim 5 wherein:

(a) the friction bracket includes an angled cutout;

(b) the rotation bar is provided with a stop pin adapted to cooperate with the angled cutout in the friction bracket to limit the rotation of the rotation bar.

7. The therapeutic treatment table of claim 5 wherein the arm support is adapted to rotate with respect to the arm support base through an angular range of about 45°.

8. The therapeutic treatment table of claim 5 wherein the arm support base includes a hinge portion that is pivotally mounted to the frame.

9. The therapeutic treatment table of claim 5 wherein:

(a) the frame includes a base mounting rod;

(b) the arm support base includes a first end having a hinge portion that is pivotally mounted to the base mounting rod so as to be retained therein with a friction fit;

wherein the cooperation between the base mounting rod and the hinge portion of the arm support base allows the first end of the arm support base to rotate with respect to the frame.

10. The therapeutic treatment table of claim 1 wherein the frame comprises:

(a) a base;

(b) a support frame to which the treatment platform and the arm support section are attached, said support frame being adapted for movement with respect to the base.

11. The therapeutic treatment table of claim 10 which includes a plurality of pairs of switches, each of which pairs is adapted to initiate movement of the support frame between a lowered position and a plurality of raised positions.

12. The therapeutic treatment table of claim 1 wherein the treatment platform comprises:

(a) a support board;

(b) an integral skin foam layer that is attached to the support board.

13. The therapeutic treatment table of claim 12 wherein the integral skin foam layer is molded to include a recessed area to improve patient comfort and security.

14. The therapeutic treatment table of claim 12 wherein the integral skin foam layer is formed from material having antimicrobial properties.

15. The therapeutic treatment table of claim 1 wherein the rotation bar has a longitudinal axis, and wherein a portion of the longitudinal axis is underneath a portion of the treatment table.

16. The therapeutic treatment table of claim 15 wherein the rotation bar has a rotational axis, and wherein the longitudinal axis and rotational axis of the rotation bar are substantially aligned.

17. The therapeutic treatment table of claim 16 wherein the longitudinal axis of the rotation bar is substantially parallel to the treatment platform.

18. The therapeutic treatment table of claim 17 further comprising at least two friction brackets and wherein the rotation bar is retained by the at least two friction brackets with a friction fit.

19. The therapeutic treatment table of claim 5 wherein the rotation bar has a longitudinal axis, and wherein the longitudinal axis of the rotation bar is substantially parallel to the arm support base.

20. The therapeutic treatment table of claim 1, wherein the frame comprises a base including a front base portion, a rear base portion, and side base members, and a support frame comprising a front support component and a rear support component, wherein the support frame is adapted for movement between a lowered position and a plurality of raised positions.

21. The therapeutic treatment table of claim 20, wherein a plurality of pairs of switches, each pair of which includes an "up" switch and a "down" switch, are provided at locations around the table and are operatively connected to a drive motor of a screw drive mechanism, wherein the switches may be activated to initiate movement of the support frame with respect to the base such that the support frame may be moved between the lowered position and the plurality of raised positions.

22. The therapeutic treatment table of claim 21, wherein a pair of switches is mounted on the front base portion, a pair of switches is mounted on the rear base portion, and two pairs of switches are mounted on each of the side base members.

23. The therapeutic treatment table of claim 21, wherein an outer housing of the "up" switches on the side base portions are configured slightly differently from an outer housing of "up" switches on the front base portion and the rear base portion, wherein the "up" switches are all functionally equivalent, wherein an outer housing of "down" switches on the side base portions are configured slightly differently from an outer housing of "down" switches on the front base portion and the rear base portion, wherein the "down" switches are all functionally equivalent, wherein the "up" switches are functionally identical to the "down" switches except that the "up" switches are wired to a motor in such a way that activation of an "up" switch will cause the support frame to move upwardly, whereas the "down" switches are wired to the motor in such a way that activation of a "down" switch will cause the support frame to move downwardly, and wherein when a switch is activated, movement is initiated in either an upward or a downward direction, and such movement continues as long as the switch is activated.

24. The therapeutic treatment table of claim 21, wherein an upper portion of the outer housing of the "down" switch on the side base portion is spaced from the side base portion with an intermediate bracket interposed therebetween, whereas a lower portion of the of the "down" switch on the side base portion abuts the intermediate bracket at an abutment, wherein a switch element is contained within the outer housing, wherein the switch element is pivotally attached to a switch contact, wherein a spring is provided to bias the switch contact away from the switch element, and wherein when the upper portion of the outer housing is pushed to the right, the outer housing pivots about the abutment, causing the bias of the spring to be overcome, so that the switch contact pivots to make electrical contact with the switch element, thereby energizing or activating the switch.

25. The therapeutic treatment table of claim 1, wherein the treatment platform comprises three body support sections including a head support section adapted to support the head of a patient, a thoracic section adapted to support shoulders and an upper torso of the patient, and a pelvic section adapted to support the patient's hips and legs.

26. The therapeutic treatment table of claim 25, wherein one or more of the three body support sections includes an actuating mechanism for moving the section with respect to one or more of the other sections or with respect to the frame.

27. The therapeutic treatment table of claim 26, wherein two fluid actuators are provided to tilt the pelvic section of the treatment table with respect to the frame.

* * * * *

UNITED STATES PATENT AND TRADEMARK OFFICE

CERTIFICATE OF CORRECTION

PATENT NO. : 8,819,879 B1
APPLICATION NO. : 12/291606
DATED : September 2, 2014
INVENTOR(S) : Greg Day It is certified that error appears in the above-identified patent and that said Letters Patent is hereby corrected as shown below:

In the Claims

In column 8 at line 36, In Claim 24, change "of the of the" to --of the--.

Signed and Sealed this
Thirty-first Day of March, 2015

Michelle K. Lee

Michelle K. Lee
*Director of the United States Patent and Trademark Office*